United States Patent [19]

Blumenthal et al.

[11] Patent Number: 4,883,322

[45] Date of Patent: Nov. 28, 1989

[54] MINING AND CONVEYING APPARATUS

[75] Inventors: Günter Blumenthal, Westerholt; Heinz Kunzer; Kurt Plaga, both of Herne, all of Fed. Rep. of Germany

[73] Assignee: Bochumer Eisenhutte Heintzmann GmbH & Co. KG, Bochum, Fed. Rep. of Germany

[21] Appl. No.: 284,976

[22] Filed: Dec. 15, 1988

[30] Foreign Application Priority Data

Dec. 19, 1987 [DE] Fed. Rep. of Germany ..... 3743239

[51] Int. Cl.[4] ..... F21C 25/56

[52] U.S. Cl. ..... 299/34; 198/735; 299/43

[58] Field of Search ..... 299/29, 34, 42, 43; 198/735, 860.2

[56] References Cited

U.S. PATENT DOCUMENTS

| | | | |
|---|---|---|---|
| 3,625,567 | 12/1971 | Blumenthal et al. | 299/43 |
| 4,026,603 | 5/1977 | Georg | 299/43 X |
| 4,282,968 | 8/1981 | Temme | 198/735 |
| 4,561,697 | 12/1985 | Hauschopp | 299/43 |

FOREIGN PATENT DOCUMENTS 3514439 10/1986 Fed. Rep. of Germany .

*Primary Examiner*—Jerome W. Massie, IV
*Assistant Examiner*—David J. Bagnell
*Attorney, Agent, or Firm*—Herbert Dubno

[57] ABSTRACT

The apparatus for removing stratified outcropped minerals and for transporting these minerals parallel to the mining face or breast comprises a digging portion and a conveyor portion as well as a chain conveyor guided positively in them with digging tools and carrier members. The digging portion and the conveyor portion are assembled together from a plurality of pan-like members. Each pan of the conveyor portion comprises a conveying trough made from two guide pieces which are mirror images of each other attached to a base plate and from two identical bent plates. The guide pieces engage in members in the bent plates and are clamped with them by clamping plates on the top side of the bent plates. The digging portion has a guide piece indentical with the guide piece of the conveyor portion. A basin-like plate of the digging portion is pivotably mounted by a welded substantially circular cross section strip on the breast wall side of the conveyor portion. Coupling members for the adjacent pan-like members of the conveyor portion are located under the bent plates.

16 Claims, 5 Drawing Sheets

MINING AND CONVEYING APPARATUS

FIELD OF THE INVENTION

Our present invention relates to an apparatus for mining and, more particularly, to an apparatus for removing mineral material from a seam at a mine face or breast and for conveying the mined mineral in a direction parallel to the mining face, e.g. in long-wall mining.

BACKGROUND OF THE INVENTION

An apparatus for recovering minerals from a seam is described in German Patent No. 35 14 439. It has trough sections forming a conveyor portion and a digging portion for respectively transporting the mined minerals and removing them from the mine face or breast. These trough-like members are formed from bent steel plates and are specially formed on the one hand for the conveying operation and on the other hand for the digging or removing and carrying function.

This apparatus has the drawback that in a replacement of the trough parts acted on by wear, the coupler parts between the trough parts always fully incorporated with them must be replaced as well. The conveyed volume of these trough parts is considerable and leads to considerable difficulty in different underground transport situations including transport in shafts, galleries and tunnels.

A considerable operating expense is connected with the time-consuming complete replacememt of the trough parts. The mining of minerals, especially coal, must be interrupted for the time for removing the trough parts which have become unserviceable and for mounting or incorporating the new trough parts.

OBJECT OF THE INVENTION

An object of our invention is to provide an improved mining apparatus which can overcome the drawbacks of this earlier system while maintaining its advantages.

It is another object of our invention to provide an improved apparatus for mining seams of minerals and for conveying these minerals parallel to the mining face or breast in which not only the mineral and quantity of the parts which must be replaced because of wear and stress is reduced, but also the time consumed in replacement is positively reduced and the work requirements for the miners during disassembly and reassembly are simplified.

SUMMARY OF THE INVENTION

These objects and others which will become more readily apparent hereinafter are attained in accordance with our invention in an apparatus for mining a mineral seam and for conveying the minerals parallel to the mining face or breast which comprises a plurality of sections contiguously joined end to end along a mine face and parallel to the wall to be mined and each assembled from a conveyor portion constituted of a plurality pan-like members, a pan-like digging portion pivotally attached substantially vertically to the upper edge of the conveyor portion on the breast wall side and so that the length of the digging portion is substantially equal to the length of the conveyor portion of each section.

A chain conveyor is guided positively in the conveyor portion and in the digging portion and carries a plurality of digging tools and carerier members.

According to our invention, each of the pan-like members of the conveyor portion comprises two guide pieces attached with each other by a base plate which are mirror images of each other and which form a channel. The guide pieces each engage and fit with a bottom side centering strip in a plurality of comparatively short members distributed over the length of the pan-like members, which are parts of two-legged bent plates which extend beyond the guide pieces which are clamped releasably with top side clamping strips between the bent plates and a plurality of clamping plates securable by screws to the bent plates.

Furthermore each of the trough parts of the digging portion extends from an unequal-legged bent basin-like plate, a guide bead being provided on the upper longitudinal edge of the basin-like plate and another guide piece which is identical with the guide piece of the conveying portion attached to the lower longitudinal edge of the digging portion being provided.

A substantially circular cross section strip is attached to the vertex portion of both legs of the basin-like plate which is clamped between the bent plate on the breast wall side and the clamping plates screwed thereon so as to be pivotable. A plurality of coupling members and crosspieces with mounting recesses are fastened in the vicinity of the screws for the clamping plates under the bent plates.

With the invention, we need only replace the parts which duty requirements make unusable. Thus, it is necessary only to replace parts in the trough-like region when wear impairing the conveying operation appears in the vicinity of the guide pieces and of the base plates joining them.

Also the clamping plates which are accessible from above need only be loosened so that the pan-like members can be lifted from the members and raised from the lower legs of the bent plates diverging gently upwardly. The channel coupling member under the bent plate and the contact or stop for the return cylinder and/or for coupling with the structural frame, for example, remain uneffected.

Furthermore, each digging portion pan can be removed in a comparatively problem-free manner from the digging portion and can be replaced by a new one as required. It is only necessary to release the clamping plates clamping the pivotable circular cross section strip located on the rear side of a digging portion pan from the breast wall side bent plate. In certain cases adjusting members pivotally connected to the digging portion pan, e.g. for pivoting the digging portion pan for adjustment of the digging tools on the breast wall where the mining is in progress, are sufficiently accessible after a slight pivoting of the digging portion pan in the direction of the breast wall so that the pivotal connection can be released directly and subsequently restored after incorporation of a new pan.

Should wear or damage occur at the place of coupling between two trough parts, one need only replace the bent plate in the exchange and not the guide pieces with the base plate.

Besides facilitating assembly, our invention also leads to a simplicity of manufacture. Each conveyor pan is symmetrical on both sides of the vertical central longitudinal plane with regard to the guide pieces, the members adjacent the bent plate and the coupling members and crosspieces located under the bent plates. This not only simplifies manufacture because the breast wall side and the excavated-tunnel side of the parts in use correspond, but also avoids assembly errors by miners in the mine under the especially difficult conditions there prevalent.

The guide pieces welded on both sides of the base plate of the conveyor portion pan are used only on the lower contacting side of each digging portion pan.

This contributes similarly to a further simplification of the apparatus according to our invention.

The guide pieces have different functions in this assembly. Besides acting as guides for the digging tools and the carrier members, the clamping strips in the vicinity of the pan-like members of the conveyor portion also have a holding function in cooperation with the clamping plates and the bent plates while they have a supporting and pivoting function with the digging portion pan. The centering strips act to mount the conveyor pan in the members in the guide pieces used in the pan-like members of the conveyor portion and have a stop member function for the pivoting members and/or the gap bridging members in the guide pieces integrated in the pan-like member.

The mounting of the clamping plates on the upper legs of the bent plate partially inclined to the breast wall and partially to the excavated-tunnel region is effected by means. Thus mounting holes or recesses are used in the crosspieces in the vicinity of the breast wall side bent plates which orient the heards of hammerhead screws satisfactorily. To secure the clamping plates, the screws are grouped together, e.g. in a triangular grouping. Thus a screw can be oriented in mounting in a crosspiece, while both other screws are oriented with regard to their heads between the lower side of the bent plate and a bit which is driven transversely through a mounting recess or hole of the crospiece.

On the excavated-tunnel or excavated tunnel side of the conveyor portion, it is not necessary to use hammerhead screws to combine the clamping plates with the bent plates since there both the upper and the lower side of the bent plates are sufficiently accessible. Here standard attachment screws with nuts can be used.

The coupling members of the invention are independent of the conveyor pan and also of the digging portion. These parts are thus no longer subjected to tension and pressure. Moreover the coupling region is now accessible in a comparatively problem-free way since the clamping plates may be removed by simply unscrewing.

According to a feature of the invention, the ends of a plurality of the clamping plates overlap on the bent plate on the breast wall side of the apparatus and are only securable by screws to the bent plate in a center longitudinal section. They are provided to mount the pan-like member of the conveyor portion and for pivotable mounting of the pan of the digging portion. Besides the desirable pivotability, it is advantageous that only one of these short clamping plates must be removed in the vicinity of two conveyor portion pan-like members and/or digging portion trough parts adjacent each other to reach the coupling region of the pan. Also these clamping plates can be formed as cast pieces so that both the overlapping regions and also the longitudinal edge region engaging the clamping strips and/or the guiding bead on the rear side of the digging portion pan can be exactly fitted and reproduced.

The clamping plate on the excavated-tunnel side can be continuous and can have approximately the length of the pan-like member of the conveyor portion and be provided with a round bead on a breast wall end longitudinal edge. An overlapping of the coupling regions is conceivable.

The round bead protruding from the clamping plate can be a round rod which has been welded on the clamping plate formed from a metal plate.

On pulling the clamping plate against the bent plate the clamping strip on the excavated-tunnel side guide piece pressures against the rounded vertex where the legs of the bent plate meet.

A substantially vertical longitudinal bridge plate welded on the clamping plate on the excavated-tunnel side can support itself with a lower longitudinal edge on the excavated-tunnel end of the clamping plate. This longitudinal bridge plate in combination with the clamping bead serves on the one hand the purpose of helping to tighten the pan-like member of the conveyor portion satisfactorily to the bent plate and on the other hand to detachably mount the attachment plate and/or other structural components such as cable ducts or the like.

At least one spacing plate can be attached beneath the clamping plate on the excavated-tunnel side of the apparatus in the vicinity of the clamping plate screws which permits the heads of the attachment screws to be completely countersunk in the material of the clamping plate so that no protruding portions are present. However, a gap is present between the top side of the upper leg of the bent plate and the spacing plate which guarantees that the excavated-tunnel side guide piece can be tightened satisfactorily to the bent plate. The spacing plate can extend also over the entire length of the clamping plate.

The coupling means or members for the pan-like members of the conveying portion comprise coupling housings welded under the ends of the bent plates and bridge-like connecting elements insertable from above with hammerhead-like enlargements on their ends. The coupling housings are thus welded on the bent plate so that their facing sides are in the plane of motion of two pan-like members. To compensate, the bent plates are dimensioned suitably shorter.

A coupling housing has a pocket, which is approximately T-shaped in horizontal cross section, whose top is open and whose bottom is closed. After alignment of two pan-like members then only the connecting elements need be pushed in the pockets from above so that the tension resistant and pressure resistant coupling of the trough parts is brought about. The play of the connecting elements in the coupling pockets is thus dimensioned so that the pan-like members can perform the relative horizontal and vertical bending with repect to each other as is required in operation.

When the surface of the hammerhead-like enlargements of the connecting elements facing each other are convex in a substantially vertical plane and fit in suitably formed concave recesses in the coupling housings, an additional support is provided by the coupling housings in all orientations inclined to the vertical plane.

The coupling housings can be equipped with the plurality of top and bottom side projections so that the height of the facing surfaces of the coupling housings can be increased and thus the benability of of the two adjacent conveying trough parts is limited.

According to another feature of our invention, a plurality of convex curved noses are provided on the facing sides of the coupling housing attached to one end of one of the pan-like members, while the coupling housing located on the other end has a plurality of concave recesses fitting the noses in the facing surfaces. These noses and recesses provide centering in assembly of the conveyor portion. They are advantageously provided in the vicinity of the coupling housing located between the conveyor trough parts and the connecting elements.

A plurality of cover plates attached to at least one of the adjacent ones of clamping plates can be provided above the coupling housing on the excavated-tunnel side. The cover plates guarantee, on the one hand, a problem-free access to the excavated-tunnel side coupling region and, on the other hand, a satisfactory bendability of the clamping plate on the excavated-tunnel side of the conveyor portion. The cover plates can be attached rigidly to the adjacent clamping plates or pivotably to a limited extent. Advantageously a screw can be used. The clamping plates end in front of the coupling region.

In an additional feature of the apparatus of our invention, a gap between two basin-like plates of the digging portions adjacent each other is covered by an overlapping cover, which sits in pockets formed by L-shaped holders attached to the basin-like plates on the excavated-tunnel side of the apparatus, engages with an upper longitudinal edge in a trough-like portion of the clamping plates on the breast wall end fitting in a substantially circular cross section strip, and supports itself with a lower longitudinal edge on a centering strip of the guide piece.

These overlapping covers bridge the gap between two adjacent digging portion trough parts. Further they act to center the adjacent digging portion trough parts in the lower region. This centering is effected by clamping plates in connection with the substantially circular cross section strip in the upper region.

The overlapping cover can be formed from different materials, advantageously from sheet metal.

Advantageously, the overlapping cover can be made of at least one material of limited elasticity, such as rubber or plastic.

In this way, the bending of two adjacent digging portion trough parts during operation can occur satifactorily without danger of damaging, bending and jamming.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
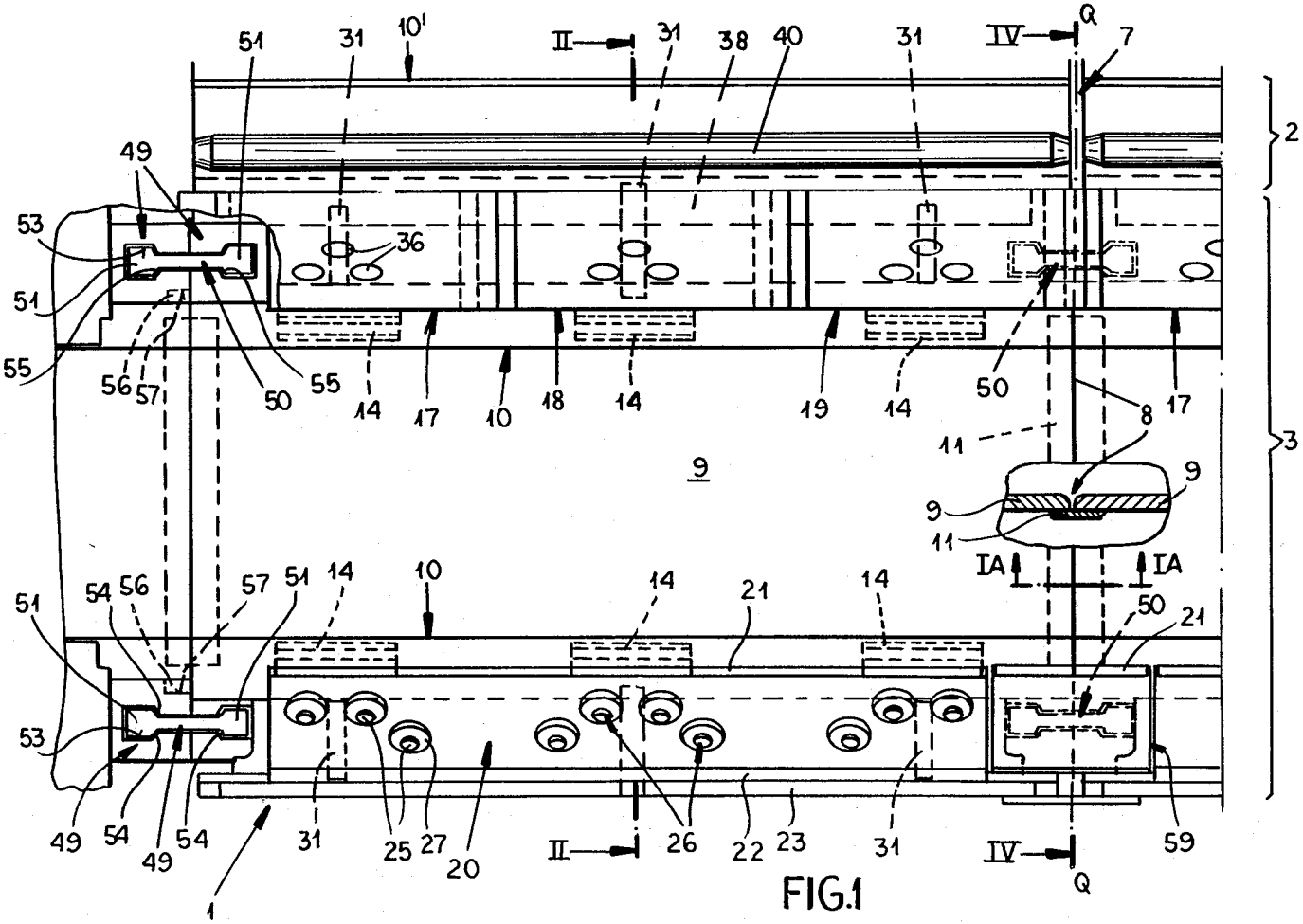
FIG. 1 is a top plan view of a longitudinal section of an apparatus mining a mineral seam and for conveying these minerals parallel to the mining face or breast.
Figure 2:
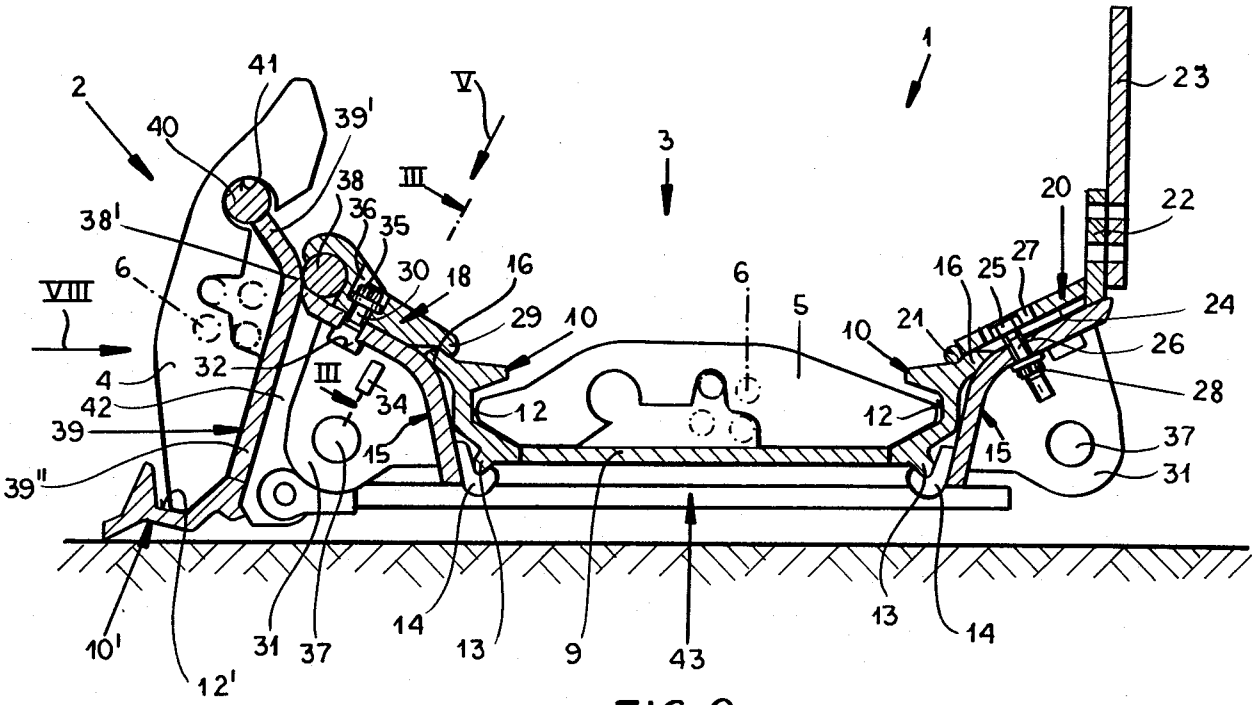
FIG. 2 is a vertical cross-sectional view through the apparatus of FIG. 1 taken along the section line II—II thereof.
Figure 4:
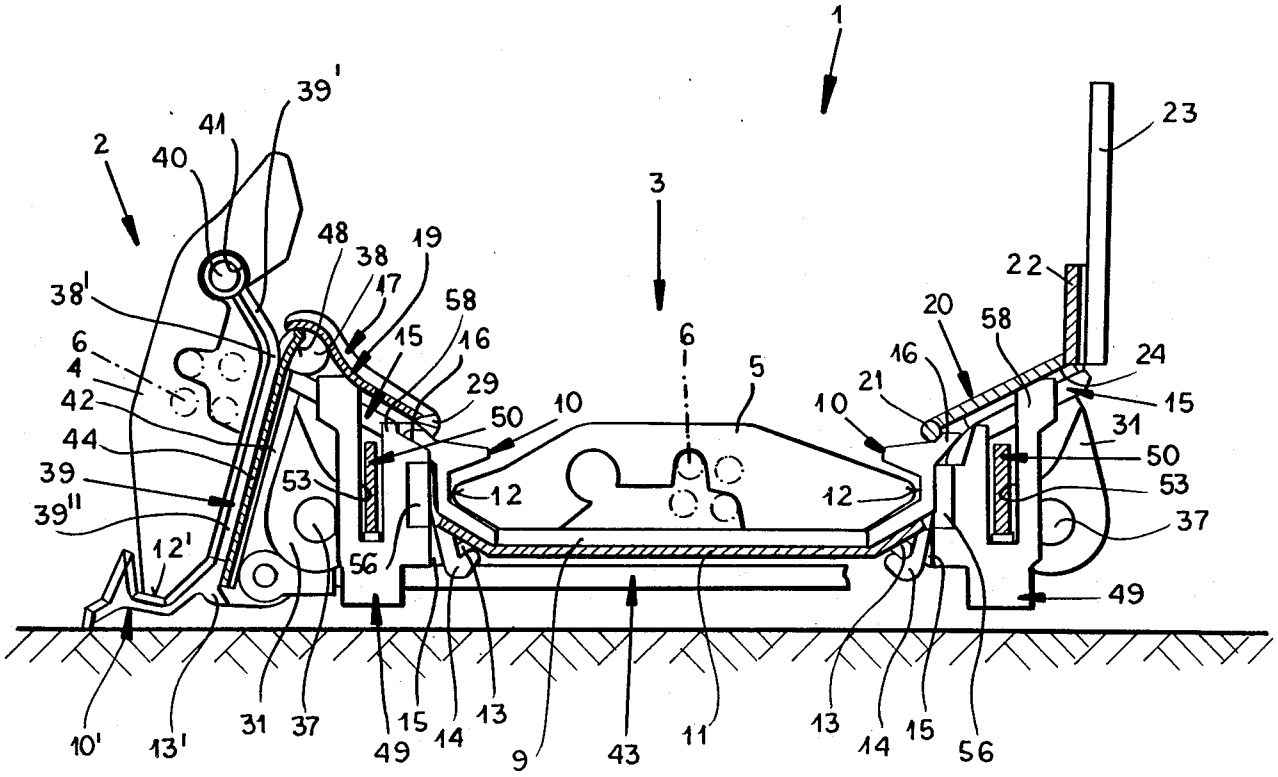
FIG. 4 is a vertical cross-sectional view thorough the apparatus shown in FIG. 1 taken along the section line IV—IV thereof.
Figure 5:
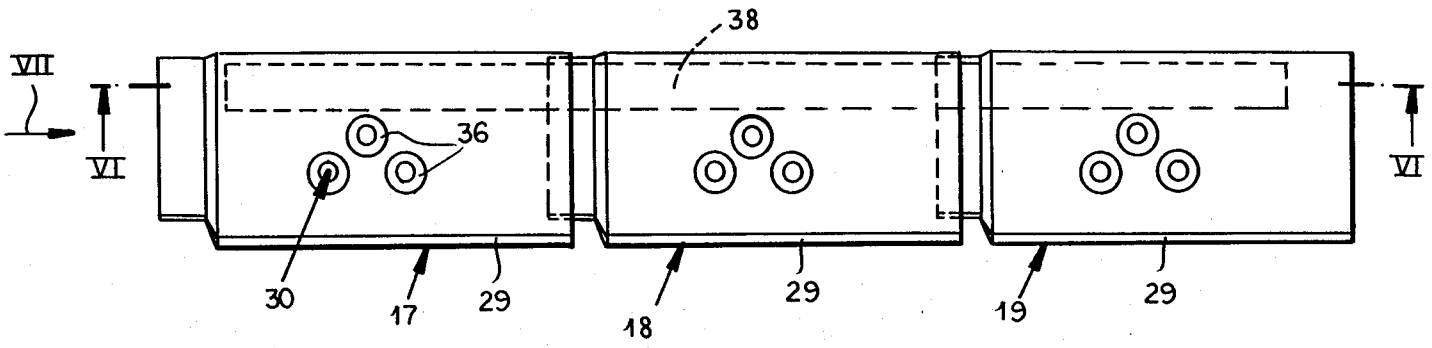
FIG. 5 is a top plan view on a longitudinal section of the excavating or mining side of the apparatus shown in FIG. 2 in the direction of the arrow V.
Figure 6:
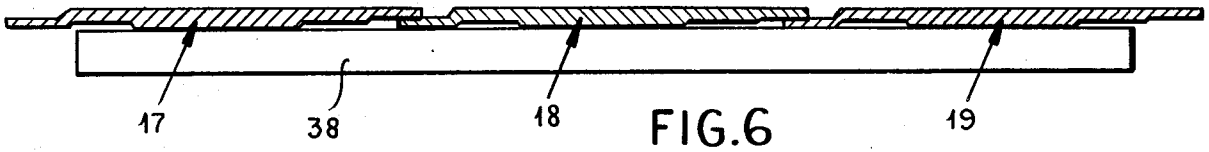
FIG. 6 is a longitudinal cross-sectional view through the apparatus shown in FIG. 5 taken along the section line VI—VI thereof.
Figure 7:
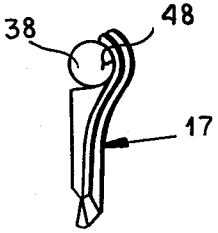
FIG. 7 is a front elevational view of the apparatus of FIG. 5 as seen in the direction of the arrow VII.

An apparatus for mining a mineral seam, especially coal, and for conveying the mind coal parallel to the mining face or breast is indicated at 1 in FIGS. 1, 2 and 4.

The apparatus 1 includes a digging portion 2 for removing mined product from the mine face or breast in long-wall mining and a conveyor portion 3 with digging tools 4 and a carrier member 5.

The digging tools 4 and the carrier members 5 not shown in detail in FIG. 1 are fixed or mounted on a round-link chain conveyor 6 which runs on drive and guide chain wheels which are positioned beyond the ends of the apparatus 1 and which are not shown in detail in the drawing.

The digging tools 4 and the carrier members 5 pass through both portions 2 and 3 so that the digging and conveying of the mined product can be effected as described in the German patent.

Also, the digging tools 4 and/or the carrier members 5 are formed so that they can transfer coal loosened from the breast wall, not shown in detail, to the conveyor portion 3.

Both the conveyor portion 3 and also the digging portion 2 for loosening the outcropped minerals are assembled in sections end to end from units formed by adjacent trough parts or pan-like members (conveyor portion) coupled to each other pivotally. The lengths of these trough parts or pan-like members are coordinated or harmonized with each other so that the pan gaps 7, 8 between units are located in approximately the same planes Q—Q.

Figure 1A:
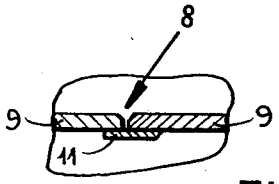
FIG. 1A is a section along IA—IA of FIG. 1.

Each pan or pan-like member of the conveyor portion 3 has two guide pieces 10 spaced from eacjh other to form a channel above a base plate 9. The guide pieces 10 are mirror images of each other (FIGS. 1, 2 and 4). The base plate is welded between the guide pieces 10. The gap 8 is covered by a gap-covering piece 11 (FIGS. 1 and 1A) in the vicinity of the displacement of the two base plates 9 which is welded under the ends of base plate 9 and engages under the adjacent base plate 9.

The ducts 12, which are approximately trapezoidal in cross section in the guide pieces 10 positively guide the digging tools 4 and the carrier member 5.

The guide pieces 10 have centering strips 13 on their lower contacting sides (see FIGS. 2 and 4), which engage in short members or hooks 14 (see also FIG. 1) distributed over the length of a pan-like member of the conveyor portion 2.

These retaining members 14, which are approximately L-shaped in cross section, form components of the two-legged bent plate 15 extending beyond the guide piece 10. They are welded on the upwardly diverging inner side of the lower leg of the bent plate 15 (FIG. 2). FIG. 1 shows that three retaining members 14 are located on each side of a pan-like member.

The upper ends of the guide pieces 10 have clamping strips 16 directed on one side toward the coal face being mined and on the other side similarly toward the excavated-tunnel side which has not been illustrated in detail. These clamping strips 16 contact on the rounded peak or upper regions of the bent plate 15. They are clamped with the bent plates 15 by clamping plates 17 to 20 both on the breast wall side and on the excavated-tunnel side.

Only one continuous clamping plate 20 is located on the excavated-tunnel side of the conveyor portion 3. It comprises a metal sheet or plate. A rounded bead 21 which comprises a substantially circular cross section rod is welded on the breast wall side longitudinal edge of the clamping plate 20. The bead 21 protrudes slightly beyond the lower end of the clamping plate 20 (see FIGS. 2 and 4).

A substantially vertical longitudinal bridge plate 22 supported with its lower longitudinal edge on the upper leg of the bent plate 15 is welded to the longitudinal edge of the clamping plate 20. The longitudinal bridge plate 22 protrudes against the lower end of the clamping plate 20 toward the bent plate 15. It acts to hold fixed top plate 23 for example, as well as the cable ducts, etc. (FIGS. 1, 2 and 4).

A spacing plate 24 is welded on under the clamping plate 20. However it is located in a space on the upper side of the bent plate 15. Because of the presence of this spacing plate 24, the heads 25 of the attachment screws (FIGS. 1 and 2) can be imbedded completely in recesses or cavities 27 in the clamping plate 20.

Held by nuts 28, the screws 26 are arranged in a triangular or trapezoidal array and thus the clamping plate 20 is tightenable against the bent plate 15 so that the excavated-tunnel side guide piece 10 can be satisfactorily clamped.

Three clamping plates 17, 18 and 19 are provided per pan length (conveyor section) on the breast wall side of the conveyor portion 3 (FIGS. 1 to 7). The ends of the clamping plates 17–19 overlap and support themselves only in the central longitudinal section on the upper side of the upper leg of the breast wall side plate 15 as can be seen especially in FIGS. 5 to 7. The clamping plates 17 to 19 have clamping noses 29 which force the clamping strips 16 in the rounded peak region of the bent plate 15 on the long side facing the conveyor portion 3.

Figure 3:
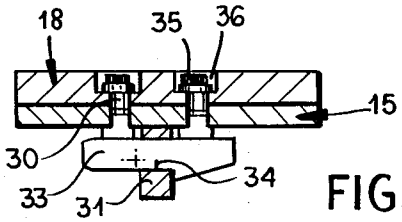
FIG. 3 is a longitudinal cross sectional view through the apparatus of FIG. 2 taken along the section line III—III.

Hammerhead screws 30 attach the clamping plates 17 to 19 to the bent plate 15. These are grouped in a triangular array. Thus the head of the excavated-tunnel side hammerhead screw 30 is located in a mounting recess 32 of a crosspiece 31 welded under the bent plate 15 (FIG. 2). The heads of both other hammerhead screws 30 of the group lie between the lower side of the bent plate and a bolt 33 which is driven in a suitably formed mounting cavity 34 in the crosspiece 31 (FIG. 3). The rotatable nuts 35 on the hammerhead screws 30 are located in the cavities 36 of the clamping plates 17 and 19.

The crosspieces 31 on the excavated-tunnel side and the breast wall side are formed identically. The crosspieces 31 distributed in the longitudinal direction along the pan-like member are provided, of which the center crosspiece 31 has an additional mounting cavity 37 for contact of a return cylinder or another attachment means, for example for coupling with a structural frame.

The breast wall side clamping plates 17 to 19 act further for the rotational positioning of a substantially circular cross section strip 38 which is welded in the vicinity of the top portion (in this example to the vertex 38' where both legs 39', 39'' meet) of a basin-shaped plate 39 with unequal legs 39', 39'' which together with a top side guide bead 40 and a bottom side guide piece 10' identical with the guide piece 10 of the conveyor portion 3 form a basin-like guide rail for the digging tools 4 and the carrier member 5.

Moreover, the digging tools 4 and the carrier member 5 are fastened to an end section in a channel 12' of the guide piece 10' and embrace the guide bead 40 with a recess 41 in the other end section on the upper longitudinal edge of the basin-like plate 39. The clamping plates 17 to 19 on the breast wall side are basin-shaped or trough-like to pivotally support the substantially circular cross section strip 38.

Figure 8:
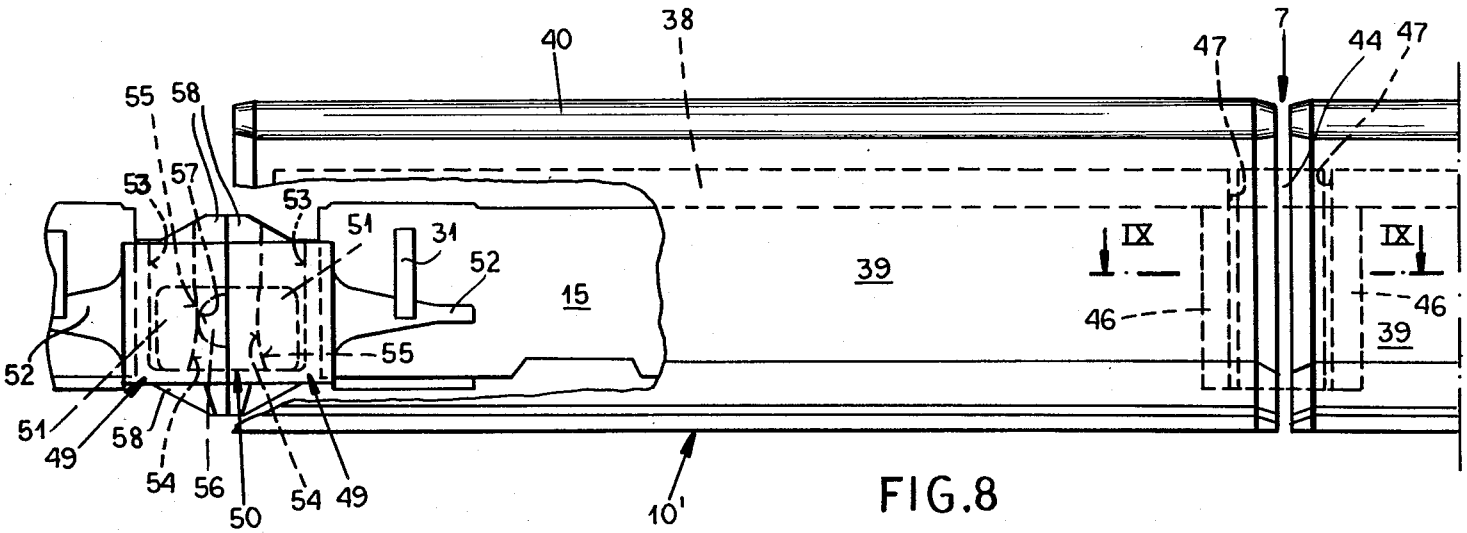
FIG. 8 is a partially sectional, partially front elevational view of the apparatus of FIG. 2 in the direction of the arrow VIII thereof.

While each pan of the digging portion 2 extends approximately up to the pan gap 7 to the adjacent pan, the substantially circular cross section strip 38, as shown in FIGS. 1 and 6 to 8, is substantially shorter. Also FIGS. 1 and 8 show that the guide bead 40 of each digging portion pan is substantially conical on its end.

On the rear end of the basin-like plate 39 of the digging portion pan two pairs of straps 42 on which pivot rods 43 are pivotally attached are welded spaced from each other (see FIGS. 1, 2 and 4) as shown in FIGS. 2 and 4. The pivot rods 43 are adjustable (in a manner not shown) on the excavated-tunnel side of the conveyor portion.

Figure 9:
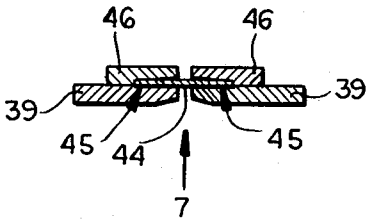
FIG. 9 is a horizontal cross-sectional view taken along the section line IX—IX of FIG. 8.

The gap 7 between two adjacent digging portion trough parts is covered by a special elastic overlapping cover 44 (FIGS. 4, 8 and 9). The overlapping cover 44 is located in pockets 45 which are formed by L-shaped holders 46 which are welded to the basin-shaped plate 39 on the excavated-tunnel side. They support themselves beneath on a centering strip 13' of the other guide piece 10' and engage with their upper ends between the facing ends 47 of the adjacent substantially circular cross section strips 38 in the trough-like portion 48 of the clamping plates 17 to 19 which overlap each other in the vicinity of two trough parts (FIGS. 4, 8 and 9).

FIGS. 1, 4 and 8 show that a coupling housing 49 for the bridge-like connecting element 50 with end hammerhead-like enlargements 51 insertable from above is attached on the end of one conveyor portion pan under the bent plate 15. The attachment is effected by welding so that pin-like extensions 52 of the coupling housings 49 increase the length of the weld seam (FIG. 8).

The coupling housings 49 have pockets 53 which are closed on the bottom and open on top. These pockets 53 are of T-shape horizontal cross section.

The surface 54 of the enlargements 51 facing each other are convex in a vertical plane and fit into suitable formed concave recesses 55 in the packets 53 of the coupling housings 49.

Furthermore, as is apparent from FIGS. 1, 4 and 8, the facing ends of the coupling housings 49 attached to one end of a pan-like member are provided with noses 56 curved convex in the vertical plane while the coupling housings 49 located on the other end have concave recesses 57 fitting the noses 56 in their facing surfaces. The noses 56 and the recesses 57 lie between the guide pieces 10 of the conveyor portions 3 and the connectoing elements 50.

Projections 58 are provided on the upper and lower side on the coupling housings 49 (FIGS. 4 and 8), which increase the height of the facing surfaces of the coupling housings 49 and because of that the bendability of the two trough parts adjacent each other.

As indicated in FIG. 1, the covering plates 59 engaged there in the region of the coupling members are provided between the excavated-tunnel side clamping plates 20 of two adjacent pan-like members. The covering plates 59 are advantageously screwed on one of the adjacent clamping plates so that bending is possible. They have clamping beads 21 on their breast wall side longitudinal edges like the clamping plates 20.

By "coupling members", we mean coupling housings 49 and connecting elements 50.

We claim:

1. In an apparatus for mining a mineral seam and for conveying said minerals in the mine longitudinal direction comprising a trough-like conveyor portion assembled from a plurality of pan-like members, a basin-like digging portion pivotally attached vertically to the upper edge of said conveyor portion on the breast wall side of said apparatus which with regard to the length of a pan of said digging portion is balanced relative to the length of a pan-like member of said conveyor portion and a chain conveyor guided positively in said conveyor portion and in said digging portion incorporating a plurality of digging tools and carrier members, the improvement wherein:

each of said pan-like members of said conveyor portion comprises two guide pieces which are mirror images of each other and which form a channel attached to each other by a base plate, said guide pieces engaging and fitting with a bottom side centering strip in a plurality of comparatively short members distributed over the length of said pan-like member of said conveyor portion which are parts of two-legged bent plates extending beyond said guide pieces and are clamped releasably with top side clamping strips between said bent plates and a plurality of clamping plates screwable to said bent plates;

each of said trough parts of said digging portion extends from an unequal-legged bent basin-like plate, a guide bead being provided on the upper longitudinal edge of said basin-like plate and another guide piece identical with said guide piece of said conveyor portion attached to the lower longitudinal edge of said basin-like plate;

a substantially circular cross section strip is attached to the vertex of both legs of said basin-like plate, which is clamped between said bent plate on said breast wall side and said clamping plates are screwed thereon so as to be pivotable; and a plurality of coupling members and a plurality of crosspieces with mounting recesses are fastened in the vicinity of the screws for said clamping plates under said bent plates.

2. The improvement defined in claim 1 wherein the ends of a plurality of said clamping plates are overlapping on said bent plate on said breast wall side and are only screwable to said bent plate in a center longitudinal section.

3. The improvement defined in claim 1 wherein said clamping plate on the excavated-tunnel side of said apparatus has approximately the length of said pan-like member of said conveyor portion and is provided with a round bead on a breast wall end longitudinal edge.

4. The improvement defined in claim 1 wherein a substantially vertical longitudinal bridge plate supporting itself with a lower longitudinal edge on said bent plate on the excavated-tunnel side of said apparatus is attached to the longitudinal edge of said clamping plate on said excavated-tunnel side.

5. The improvement defined in claim 4 wherein at least one spacing plate is attached beneath said clamping plate on said excavated-tunnel side.

6. The improvement defined in claim 5 wherein said coupling members comprise a plurality of coupling housings for a plurality of bridge-like connecting elements insertable from above with enlargements having hammerhead-like ends attached to the ends of one of said pan-like members of said conveyor portion.

7. The improvement defined in claim 6 wherein the surfaces facing each other of said hammerhead-like enlargements are convex in a substantially vertical plane and are fit in suitably formed concave cavities in said coupling housing.

8. The improvement defined in claim 6 wherein said coupling housing is equipped with a plurality of top and bottom side projections.

9. The improvement defined in claim 6 wherein a plurality of convex curved noses are provided on the facing sides of said coupling housings attached to one end of one said pan-like members while said coupling housing located on the other end has a plurality of concave recesses fitting said noses in said facing surfaces.

10. The improvement defined in claim 6 wherein a plurality of cover plates attached to at least one of the adjacent ones of said clamping plates are provided above said coupling housing on the excavated-tunnel side of said apparatus.

11. The improvement defined in claim 1 wherein a gap between two of said basin-like plates of said digging portions adjacent each other is covered by an overlapping cover, which sits in a plurality of pockets formed by L-shaped holders attached to said basin-like plates on the excavated-tunnel side, engages with an upper longitudinal edge in a trough-like portion of said clamping plates on said breast wall end fitting said substantially circular cross section strip and supports itself with a lower longitudinal edge on a centering strip of said other guide piece.

12. The improvement defined in claim 11 wherein said over-lapping cover is formed by a piece of sheet metal.

13. The improvement defined in claim 11 wherein said over-lapping cover is made of at least one material of limited elasticity.

14. The improvement defined in claim 13 wherein said material of limited elasticity is rubber.

15. The improvement defined in claim 13 wherein said material of limited elasticity is plastic.

16. An apparatus for mining a mineral seam and for conveying said minerals parallel to the mining face or breast comprising:

a trough-like conveyor portion assembled from a plurality of pan-like members, each of said pan-like members of said conveyor portion comprising two guide pieces which are mirror images of each other and which form a channel attached to each other by a base plate, said guide pieces engaging and fitting with a bottom side centering strip in a plurality of comparatively short members distributed over the length of said pan-like member of said conveyor portion which are parts of two-legged bent plates extending beyond said guide pieces and are clamped releasably with top side clamping strips between said bent plates and a plurality of clamping plates screwable to said bent plates, the ends of a plurality of said clamping plates on the breast wall end of said bent plate overlapping and being only screwable to said bent plate in a center longitudinal section, said clamping plate on the excavated-tunnel side having approximately the length of said pan-like member and being provided with a round bead on a breast wall side longitudinal edge;

a basin-like digging portion pivotally attached substantially vertically to the upper edge of said conveyor portion on the breast wall side of said apparatus, each of the trough parts of said digging portion extending from an unequal-legged bent basin-like plate, a guide provided on the upper longitudinal edge of said basin-like plate and another guide piece identical with said guide piece of said conveyor portion attached to the lower longitudinal edge of said basin-like plate;

a substantially circular cross section strip attached to the vertex of both legs of said basin-like plate, which is clamped between said bent plate on said breast wall side and said clamping plates screwed thereon so as to be pivotable;

a plurality of coupling members and crosspieces with mounting recesses fastened in the vicinity of a plurality of screws of said clamping plates under said bent plates;

a substantially vertical longitudinal bridge plate supporting itself with a lower longitudinal edge on said bent plate on the excavated-tunnel side attached to the longitudinal edge of said clamping plate on said excavated-tunnel side, at least one spacing plate being attached beneath said clamping plate on said excavated-tunnel side;

coupling housings for a plurality of bridge-like connecting elements insertable from above attached to enlargements having hammerhead-like ends to the ends of one of said pan-like members, the surfaces facing each other of said hammerhead-like emlargements being convex in a substantially vertical plane and being fit in suitably formed concave recesses in said coupling housings which are provided with a plurality of top and bottom side projections, a plurality of convex curved noses being provided on the facing sides of said coupling housings attached to one end of one of said pan-like members while said coupling housing located on the other end has a plurality of concave recesses fitting said noses in said facing surfaces; and a chain conveyor guided positively in said conveyor portion and in said digging portion incorporating a plurality of digging tools and carrier members.

* * * * *